US007343711B2

(12) United States Patent
Manders et al.

(10) Patent No.: US 7,343,711 B2
(45) Date of Patent: Mar. 18, 2008

(54) ADJUSTABLE DOOR ASSEMBLY FOR A WALK-IN ENVIRONMENTALLY CONDITIONED ROOM

(75) Inventors: Mark T. Manders, Lino Lakes, MN (US); Randy J. Clay, River Falls, WI (US)

(73) Assignee: Nor-Lake, Incorporated, Hudson, WI (US)

( * ) Notice: Subject to any disclaimer, the term of this patent is extended or adjusted under 35 U.S.C. 154(b) by 458 days.

(21) Appl. No.: 10/915,997

(22) Filed: Aug. 11, 2004

(65) Prior Publication Data

US 2006/0032145 A1 Feb. 16, 2006

(51) Int. Cl.
*E05D 7/00* (2006.01)

(52) U.S. Cl. ..... 49/397; 16/235; 16/238; 16/DIG. 39; 16/DIG. 43

(58) Field of Classification Search ..... 49/397; 16/235, 236, 237, 238, DIG. 39, DIG. 43
See application file for complete search history.

(56) References Cited

U.S. PATENT DOCUMENTS 4,045,841 A 9/1977 Röck et al.
4,227,284 A 10/1980 Zernig
5,074,611 A * 12/1991 Newkirk ..... 296/146.6
5,644,817 A * 7/1997 Bender et al. ..... 16/382
5,787,550 A * 8/1998 Bender ..... 16/382
5,799,370 A 9/1998 Davidian et al.
5,904,014 A * 5/1999 Ripamonti et al. ..... 52/217
6,434,791 B1 8/2002 Chung
6,438,843 B1 * 8/2002 Tarahomi ..... 29/897.2
6,511,120 B1 * 1/2003 Mitts ..... 296/202
7,014,283 B2 * 3/2006 Grace et al. ..... 312/406
2002/0073509 A1 6/2002 Dean

* cited by examiner

*Primary Examiner*—Jerry Redman
(74) *Attorney, Agent, or Firm*—IPLM Group, P.A.

(57) ABSTRACT

A preferred embodiment adjustable door includes a bracket having a front and sides defining a cavity, and one of the sides includes a retaining member. A tapping plate fits within the cavity and is operatively connected to the adjustable door with the bracket. The tapping plate includes a first aperture and a second aperture in communication with and extending perpendicular to one another. The first aperture is proximate an end of the tapping plate and corresponds with the retaining member. The adjusting member fits within the second aperture of the tapping plate. The fastener is engaged by the retaining member of the bracket. The fastener extends through the first aperture into the second aperture and mates with the adjusting member. The adjusting member moves along the shaft of the fastener as the fastener is rotated, which moves the tapping relative to the fastener and the bracket.

12 Claims, 5 Drawing Sheets

ADJUSTABLE DOOR ASSEMBLY FOR A WALK-IN ENVIRONMENTALLY CONDITIONED ROOM

BACKGROUND OF THE INVENTION

1. Field of the Invention

The present invention relates to an adjustable door assembly and, more particularly, an adjustable door assembly for a walk-in environmentally conditioned room.

2. Description of the Prior Art

Doors are not always square when installed within door frames, which may be due to uneven floors or other factors, and the doors must commonly be adjusted when being installed within the door frames. Sometimes the doors and/or the door frames are manually deformed so that the doors appear to be oriented correctly within the door frames. This can be very time-consuming and require much skill. Alternatively, adjustable hinges are known for adjusting the doors relative to the door frames so that the doors will fit within the door frames. However, once the hinges are secured it may be very difficult to actually perform the adjustments. Therefore, there is a need for an assembly allowing simple adjustments of doors within door frames.

SUMMARY OF THE INVENTION

A preferred embodiment adjustable door configured and arranged to fit within a door frame includes a bracket, a tapping plate, an adjusting member, and a fastener. The adjustable door has a first panel and a first cavity. The first panel has an inside surface and a first aperture. The bracket has a front and sides defining a second cavity, and one of the sides includes a retaining member. The tapping plate is configured and arranged to fit within the second cavity of the bracket and is operatively connected to the inside surface within the first cavity of the adjustable door with the bracket. The tapping plate includes a second aperture and a third aperture extending perpendicular to one another. The second aperture is proximate an end of the tapping plate and corresponds with the retaining member and is in communication with the third aperture. The adjusting member is configured and arranged to fit within the second aperture of the tapping plate. The retaining member of the bracket engages the fastener to prevent movement along a longitudinal axis of the fastener, and the fastener extends through the second aperture into the third aperture and is configured and arranged to mate with the adjusting member. The adjusting member moves along the fastener as the fastener is rotated thereby moving the tapping plate along the fastener as the fastener is rotated, and the tapping plate moves relative to the fastener and the bracket.

A preferred embodiment adjustable door configured and arranged to fit within a door frame includes a first cavity, a bracket, a tapping plate, an adjusting member, a fastener, and a hinge. The first cavity is defined between an outer panel and an inner panel of the adjustable door. The outer panel of the adjustable door has an inside surface proximate the first cavity and an outside surface. The outer panel has a first aperture. The bracket has a front and sides defining a second cavity, and one of the sides includes a retaining member. The tapping plate is operatively connected to the inside surface of the adjustable door with the bracket, and the tapping plate has a smaller size than the bracket and is configured and arranged to fit within the second cavity of the bracket. The tapping plate includes a second aperture and a third aperture extending perpendicular to one another. The second aperture is proximate an end of the tapping plate and corresponds with the retaining member and is in communication with the third aperture. The adjusting member is configured and arranged to fit within the third aperture. The retaining member of the bracket engages the fastener to prevent movement along a longitudinal axis of the fastener, and the fastener extends through the second aperture into the third aperture and is configured and arranged to mate with the adjusting member. The hinge member is operatively connected to the outer surface of the outer panel of the adjustable door with a second fastener. The second fastener extends through the first aperture of the outer panel and into the tapping plate. The fastener allows movement of the hinge member when the second fastener is loosened and the fastener is rotated relative to the adjusting member. The adjusting member moves along the fastener as the fastener is rotated thereby moving the tapping plate relative to the fastener and the bracket which moves the second fastener and the hinge member relative to the outer panel.

A preferred embodiment method of adjusting a door within a door frame includes placing a tapping plate within a cavity of a bracket. The bracket has a retaining member, and the tapping plate includes a first aperture and a second aperture extending perpendicular to one another. The first aperture is proximate an end of the tapping plate and corresponds with the retaining member and is in communication with the second aperture. The adjusting member is placed within the second aperture. The fastener is placed within the retaining member, and the retaining member engages the fastener, which extends through the first aperture and into the second aperture to engage the adjusting member. The bracket is attached to the door, and the hinge is attached to the door with at least one screw extending through an aperture in the door and into the tapping plate. The fastener is rotated within the retaining member thereby causing the adjusting member and the tapping plate to move along a shaft of the fastener thereby causing the at least one screw to move relative to the door thereby adjusting the door to fit within the door frame.

A preferred embodiment adjustable door is configured and arranged to fit within a door frame of a walk-in environmentally conditioned room and includes a bracket, a tapping plate, an adjusting member, and a fastener. The adjustable door has a first panel and a first cavity, and the first panel has an inside surface and a first aperture. The bracket has a front and sides defining a second cavity, and one of the sides includes a second aperture. The tapping plate is configured and arranged to fit within the second cavity of the bracket and is operatively connected to the inside surface within the first cavity of the adjustable door with the bracket. The tapping plate includes a third aperture and a fourth aperture extending perpendicular to one another. The third aperture is proximate an end of the tapping plate and corresponds with the second aperture and is in communication with the fourth aperture. The adjusting member is configured and arranged to fit within the third aperture of the tapping plate. The fastener has a groove, and the second aperture of the bracket engages the groove. The fastener extends through the second aperture and the third aperture into the fourth aperture and is configured and arranged to mate with the adjusting member. The adjusting member moves along the fastener as the fastener is rotated thereby moving the tapping plate along the fastener as the fastener is rotated. The tapping plate moves relative to the fastener and the bracket.

DETAILED DESCRIPTION OF A PREFERRED EMBODIMENT

Figure 1:
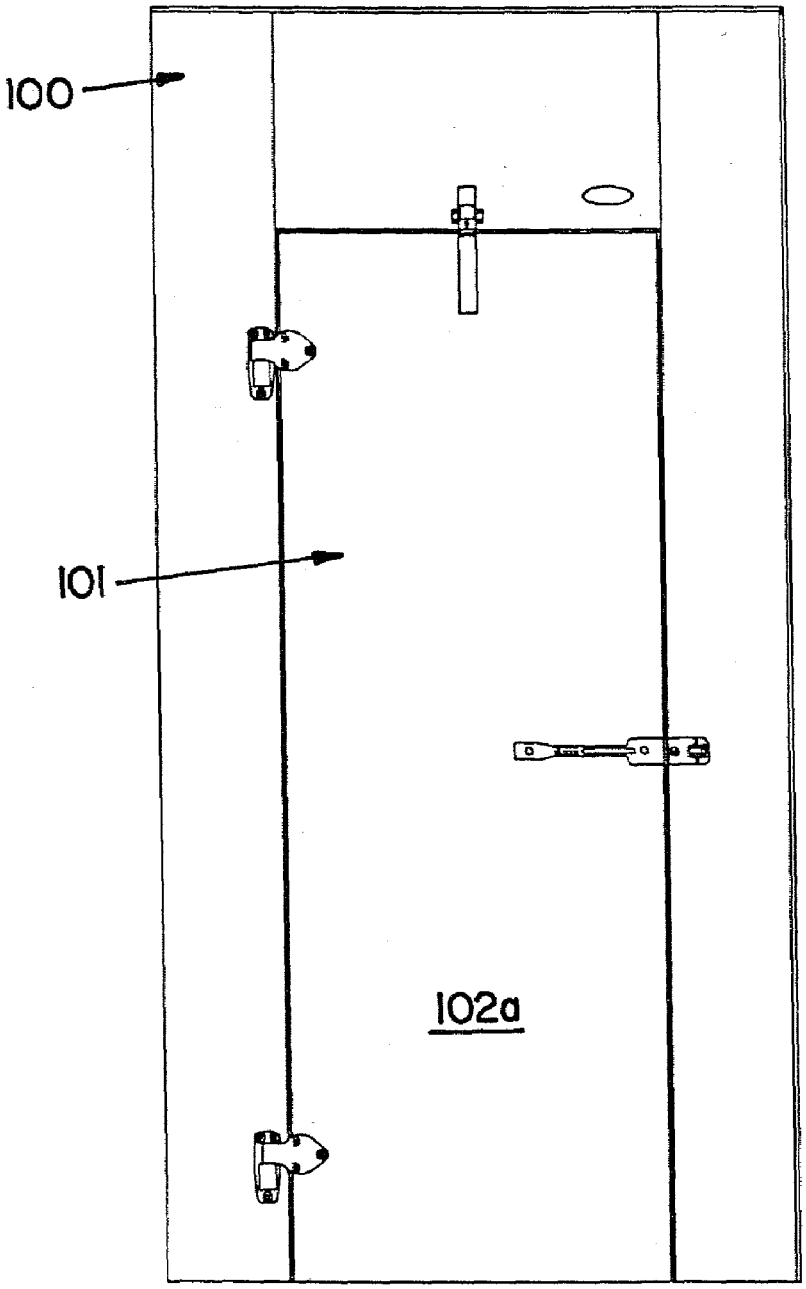
FIG. 1 is a front elevational view of a walk-in environmentally conditioned room.

A preferred embodiment adjustable door assembly constructed according to the principles of the present invention is designated by the numeral 101 in the drawings.

The door of a walk-in environmentally conditioned room 100 is one type of door that commonly requires adjustment during installation within the door frame 100*a*. Although the present invention is discussed with regard to the door of a walk-in environmentally conditioned room 100, it is recognized that any suitable type of door may be used.

The adjustable door assembly 101 includes an outer panel 102 and an inner panel 103, between which is a cavity 126. The outer panel 102 has an outside surface 102*a* and an inside surface 102*b*. A side 117 extends perpendicular from the outer panel 102 toward the cavity 126 and has an aperture 117*a*. A flange 119 extends perpendicular from the side 117, parallel with the outer panel 102, toward the cavity 126. An intermediate portion 123 extends perpendicular from the inner panel 103 toward the cavity 126. A door jam 104 interconnects the side 117 and the intermediate portion 123 with a flange 104*a*. The flange 119 mates with the door jam 104 to seal the outer panel 102 and the inner panel 103 together. In the case of the walk-in environmentally conditioned room 100, the cavity 126 contains insulation.

Figure 6:
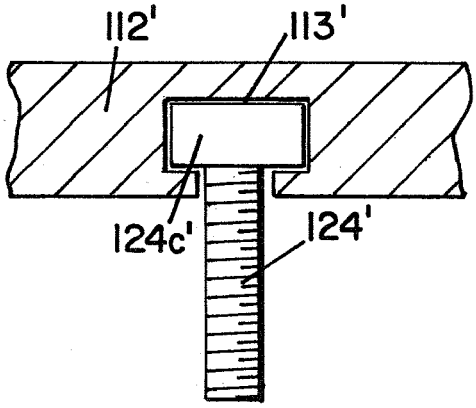
FIG. 6 is a schematic view of a portion of another embodiment bracket assembly and a fastener for use with the adjustable door assembly shown in FIG. 2.

A bracket 105 includes a front 106, which is a rectangular plate member, having a first side 112, a second side 114, a third side 115, and a fourth side 116 extending outward perpendicular from each edge of the front 106. The first side 112 has a notch 113 extending from the outer edge toward the front 106 and is proximate a center portion of the first side 112. The notch 113 may also be a slot or any other suitable type of retaining member. An example of another suitable type of retaining member is a cavity 113' in a first side 112' as shown in FIG. 6. Extending outward perpendicular from sides 114, 115, and 116 are flanges 114*a*, 115*a*, and 116*a*, respectively, which are generally parallel to the front 106 and provide a mounting surface for the bracket 105. The front 106 and the sides 112, 114, 115, and 116 form a cavity 127.

Figure 2:
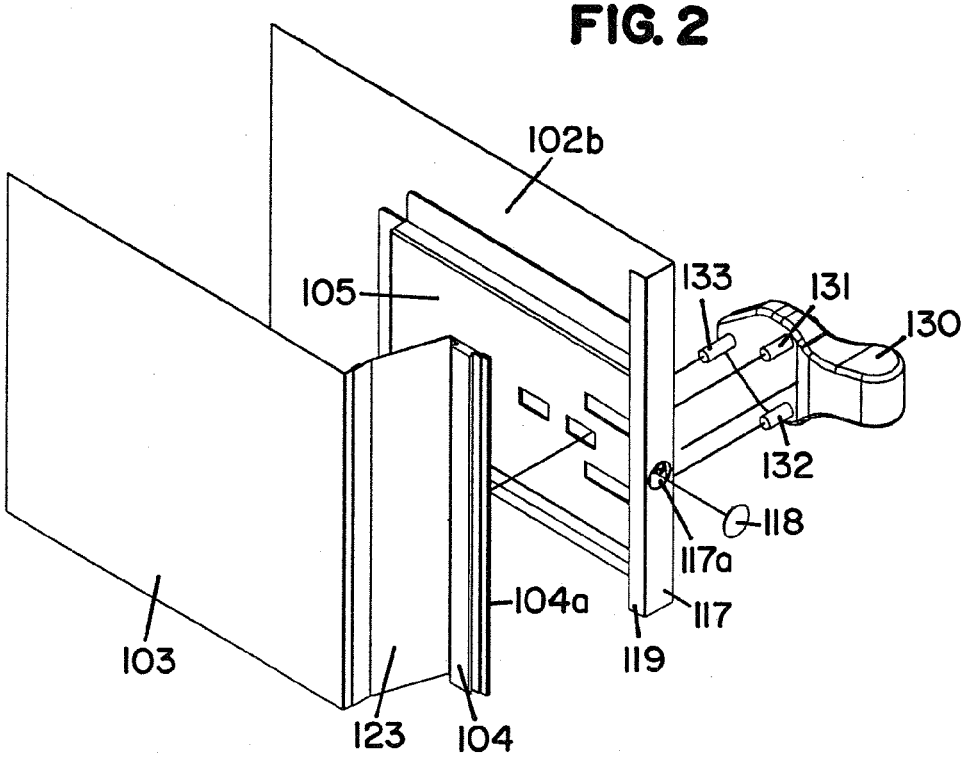
FIG. 2 is an exploded perspective view of an adjustable door assembly constructed according to the principles of the present invention.
Figure 3:
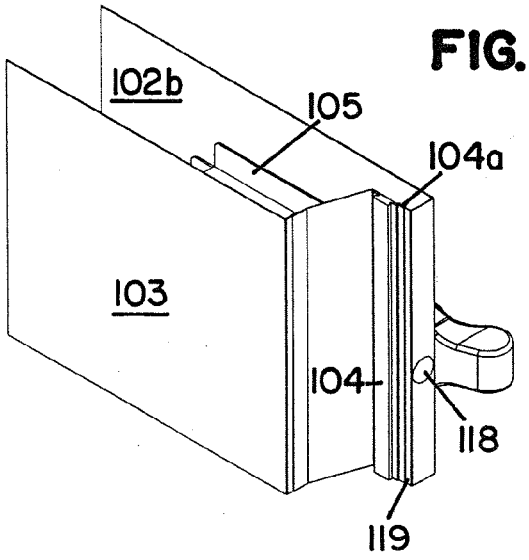
FIG. 3 is a back perspective view of the adjustable door assembly shown in FIG. 2.
Figure 4:
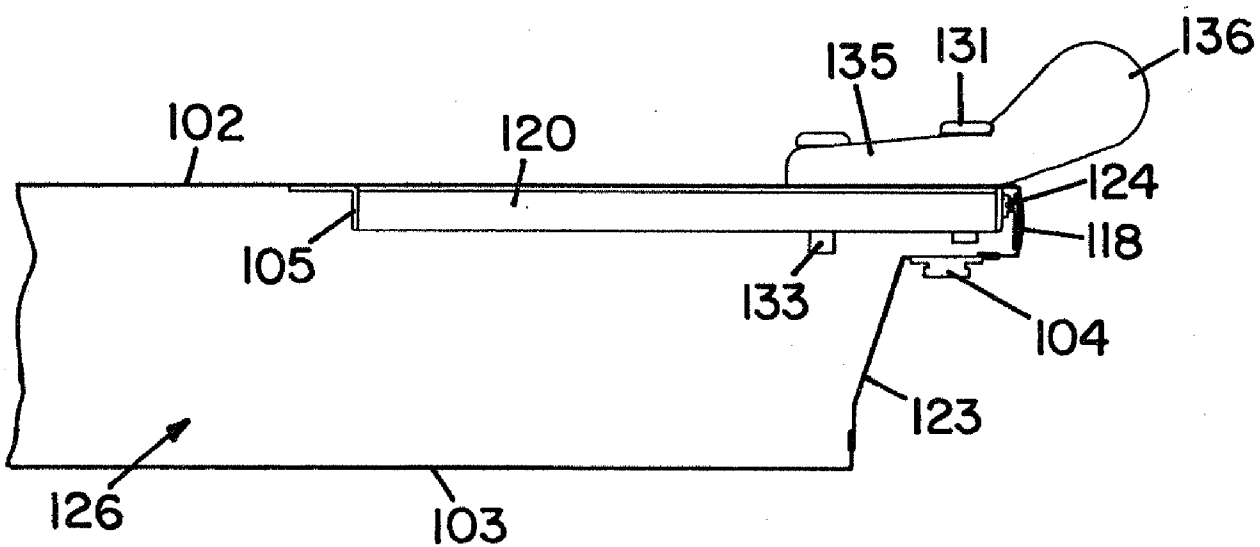
FIG. 4 is a top cross sectional view of the adjustable door assembly shown in FIG. 2.
Figure 5:
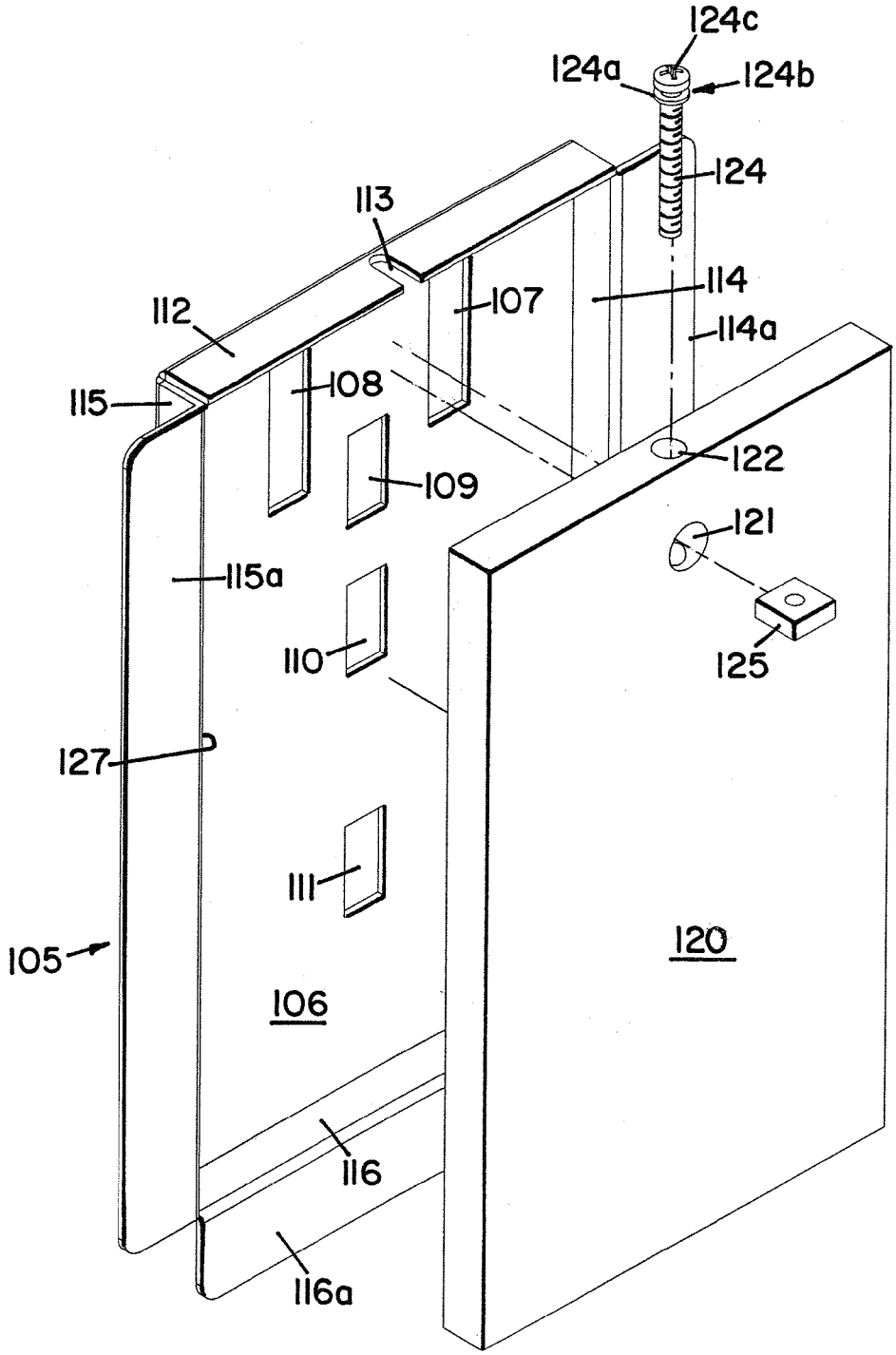
FIG. 5 is an exploded perspective view of a bracket assembly of the adjustable door assembly shown in FIG. 2.

The front 106 also has several rectangular slots preferably running in the same direction as the length of the front 106. Although the bracket 105 is preferably positioned horizontally relative to the outer panel 102, as shown in FIG. 2, the slots are being described positioned vertically relative to the outer panel 102, as shown in FIG. 5. Slots 107 and 108 are proximate the first side 112, one on each side of the notch 113. Slot 109 is positioned between the slots 107 and 108 proximate the lower portions of the slots 107 and 108. Slot 110 is positioned below slot 109, and slot 111 is positioned below slot 110. Slots 110 and 111 are proximate a middle portion of the front 106.

A tapping plate 120 is a rectangular plate member preferably made of plastic or metal into which fasteners may be secured. The tapping plate 120 is preferably configured and arranged to fit within the cavity 127 of the bracket 105. The tapping plate 120 should preferably be shorter in length than the length of the cavity 127 to allow for movement of the tapping plate 120 within the cavity 127 of the bracket 105 toward or away from the aperture 117*a*. The tapping plate 120 includes an aperture 121 proximate one end, and the aperture 121 is configured and arranged to receive and retain an adjusting member 125, which is preferably a square shaped nut. An aperture 122, which is preferably a bore, extends from one end of the tapping plate 120 into the aperture 121 and is in communication with the aperture 121.

A fastener 124 includes a flange 124*a*, a groove 124*b*, and a head 124*c*. The flange 124*a* is between the threaded shaft of the fastener 124 and the head 124*c*, and there is a gap between the flange 124*a* and the head 124*c*, which defines the groove 124*b*. The flange 124*a* and the head 124*c* extend outward from the shaft, and the groove 124*b* is approximately the same diameter as the shaft. Therefore, the gap between the flange 124*a* and the head 124*c* define the groove 124*b*. The groove 124*b* fits within the notch 113 of the bracket 105 so that the bracket 105 engages the fastener 124 and prevents movement along a longitudinal axis of the fastener 124 when the fastener 124 is rotated. This is shown in FIG. 5. Similarly, the cavity 113' is configured and arranged to engage the head 124*c*' of a fastener 124' to prevent movement along a longitudinal axis of the fastener 124'. By engaging the fastener, the bracket retains the fastener. This is shown in FIG. 6.

Figure 7:
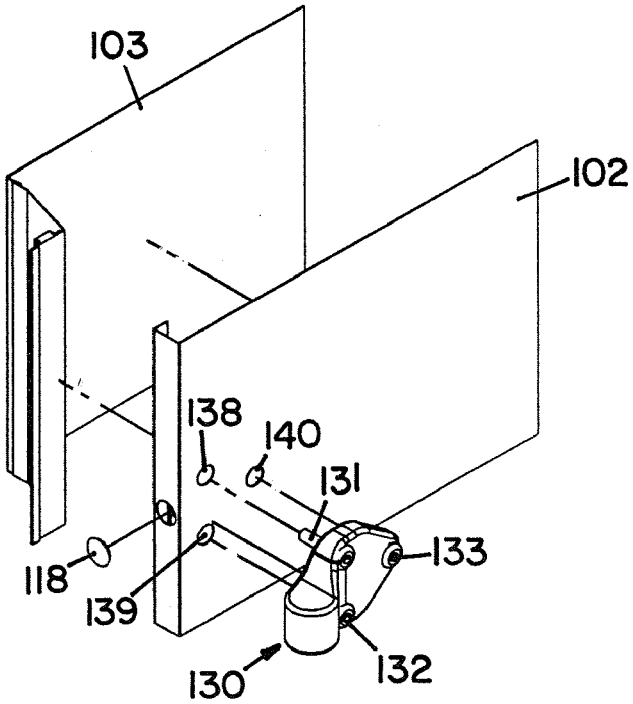
FIG. 7 is an exploded perspective view of a portion of the adjustable door assembly shown in FIG. 2.

Hinge member 130 includes a base portion 135 and a connector portion 136. The base portion 135 is the portion operatively connected to the outer panel 102, and the connector portion 136 is the portion operatively connected to another hinge member (not shown but well known in the art) that is operatively connected to the door frame. The base portion 135 has apertures through which the shafts of fasteners 131, 132, and 133 are inserted to secure the base portion 135 to the outer panel 102. The outer panel 102 includes enlarged apertures 138, 139, and 140 as shown in FIG. 7 through which the shafts of the fasteners 131, 132, and 133 are inserted, respectively. The enlarged apertures 138, 139, and 140 are larger than the diameter of the shafts of the fasteners 131, 132, and 133, which are preferably screws. The fasteners 131, 132, and 133 screw into the tapping plate 120 and when sufficiently secured secure the hinge member 130 tightly to the outer panel 102. It is recognized that most any type of hinge member may be used provided that the arrangement of the fasteners of the hinge member corresponds with the enlarged apertures in the outer panel 102 and the slots in the bracket 105, which could be positioned in any suitable arrangement.

To assemble the adjustable door assembly 101, an assembly 101 is preferably positioned proximate each hinge placement of the door. The adjusting member 125 is placed in the aperture 121 of the tapping plate 120 and the fastener 124 is inserted through the aperture 122, which is in communication with the aperture 121. The fastener 124 is then threaded through the adjusting member 125. The tapping plate 120 and the fastener 124 are placed within the cavity 127 of the bracket 105, placing the notch 113 of the bracket 105 within the groove 124*a* of the fastener 124 to secure the fastener 124 within the bracket 105. Alternatively, the head 124*c*' of the fastener 124' is placed within the cavity 113' to similarly secure the fastener 124'. Therefore, the fastener 124 or the fastener 124' does not move relative to the bracket 105 and does not protrude outward therefrom. The hinge member 130 is calibrated using a calibration gauge, as is well known in the art. The gauge is inserted between the tapping plate 120 and the bracket 105, and the fastener 124 is tightened to pull the tapping plate 120 to the gauge proximate the fastener 124. The gauge is then removed.

The tapping plate 120 and the bracket 105 are positioned over pre-punched, enlarged apertures in the outer panel 102 of the door using the slots in the bracket 105 to center the bracket 105, which should be all the way under the flange 119 and pushed tight against the side 117. The flanges 114*a*, 115*a*, and 116*a* of the bracket 105 provide a mounting surface and contact the inside surface 102*b* of the outer panel 102. A screwdriver may be used as a guide to align the slots of the bracket 105 with the apertures of the outer panel 102. Using masking tape, the flanges 114*a*, 115*a*, and 116*a* of the bracket 105 are taped into place. Foam tape is preferably placed proximate the adjusting end and the top edge of the adjusting end of the bracket 105. Care is taken not to cover the fastener 124 or 124' with the foam tape. Tape and/or permagum is applied to any gaps on the bracket 105 or between the bracket 105 and the outer panel 102. Glue is sprayed over the bracket 105. The seams are then permagummed proximate the corners.

The side 117 is notched to allow for insertion of the plug 118 into the aperture 117*a*, which is in alignment with the fastener 124 or 124', and the flange 119 is placed within the door jam 104 to interconnect the outer panel 102 and the inner panel 103. The fasteners 131, 132, and 133 of the hinge member 130 are then aligned with the apertures in the outer panel 102 and then screwed into the tapping plate 120 and through the slots in the bracket 105. Fastener 131 corresponds with aperture 138 and slot 108, fastener 132 corresponds with aperture 139 and slot 107, and fastener 133 corresponds with aperture 140 and slot 109. The fastener 124 or 124' is aligned in the proper pre-punched aperture 117*a* in the side 117, and the plug 118 is placed in the aperture 117*a* on the side 117.

In operation, adjustments to the assembly 101 are simple. First, the fasteners 131, 132, and 133 are loosened and the plug 118 is removed from the aperture 117*a*. The side 117 of the outer panel 102 has an aperture 117*a* allowing access to the head 124*c* or 124*c*' of the fastener 124 or 124', respectively. When assembled, the fasteners 131, 132, and 133 of the hinge member 130 need only be loosened enough to release the friction between the hinge member 130 and the outer panel 102 to make adjustments. Then, a screwdriver is inserted into the aperture 117*a* to engage the head 124*c* or 124*c*' of the fastener 124 or 124'. The fastener 124 or 124' is rotated by the screwdriver, which causes the adjusting member 125 to move along the shaft of the fastener 124 or 124' thereby moving the tapping plate 120 with the adjusting member 125. The fastener 124 or 124' is stationary relative to the bracket 105 because the groove 124*a* fits within the notch 113 of the bracket 105 or the head 124*c*' fits within the cavity 113', and the tapping plate 120 "floats" within the cavity 127 of the bracket 105 as the fastener 124 or 124' is rotated. The adjusting member 125 is captured by the tapping plate 120 so the rotating of the fastener 124 or 124' moves the adjusting member 125, the tapping plate 120, and the hinge member 130 along the shaft of the fastener 124 or 124'. The fasteners 131, 132, and 133 remain secured in the tapping plate 120 and protrude through the slots in the bracket 105. The enlarged apertures in the outer panel 102 allow for adjustment of the assembly 101. When the desired adjustments have been made, the fasteners 131, 132, and 133 are tightened and the friction between the hinge member 130 and the outer panel 102 keeps the door in place within the door frame. When adjustments are not necessary, the plug 118 may be inserted into the aperture 117*a* to protect the fastener 124 or 124'. The fastener 124 or 124' is "hidden" by the plug 118 when not being used for adjustment of the assembly 101.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An adjustable door configured and arranged to fit within a door frame, the adjustable door having a first panel and a first cavity, the first panel having an inside surface and a first aperture, comprising:

a) a bracket having a front and sides defining a second cavity, one of the sides including a retaining member;

b) a tapping plate configured and arranged to fit within the second cavity of the bracket and operatively connected to the inside surface within the first cavity of the adjustable door with the bracket, the tapping plate including a second aperture and a third aperture, the second aperture and the third aperture extending perpendicular to one another, the second aperture being proximate an end of the tapping plate and corresponding with the retaining member and being in communication with the third aperture;

c) an adjusting member within the second aperture of the tapping plate; and d) a fastener, the retaining member of the bracket engaging the fastener to prevent movement along a longitudinal axis of the fastener, the fastener extending through the second aperture into the third aperture and configured and arranged to mate with the adjusting member, the adjusting member moving along the fastener as the fastener is rotated thereby moving the tapping plate along the fastener as the fastener is rotated, the tapping plate moving relative to the fastener and the bracket.

2. The adjustable door of claim 1, further comprising a hinge operatively connected to the adjustable door with a second fastener, the second fastener extending through the first aperture into the tapping plate, wherein rotation of the fastener moves the tapping plate and the second fastener relative to the adjustable door thereby fitting the adjustable door within the door frame.

3. The adjustable door of claim 1, further comprising a fourth aperture in the first panel of the adjustable door allowing access to the fastener and further comprising a plug configured and arranged to cover the fourth aperture thereby preventing access to the fastener.

4. The adjustable door of claim 1, wherein the retaining member is a notch configured and arranged to engage a groove of the fastener.

5. The adjustable door of claim 1, wherein the retaining member is a cavity configured and arranged to engage a head of the fastener.

6. An adjustable door configured and arranged to fit within a door frame, comprising:

a) a first cavity defined between an outer panel and an inner panel of the adjustable door, the outer panel of the adjustable door having an inside surface proximate the first cavity and an outside surface, the outer panel having a first aperture;

b) a bracket having a front and sides defining a second cavity, one of the sides including a retaining member;

c) a tapping plate operatively connected to the inside surface of the adjustable door with the bracket, the tapping plate having a smaller size than the bracket and being configured and arranged to fit within the second cavity of the bracket, the tapping plate including a second aperture and a third aperture, the second aperture and the third aperture extending perpendicular to one another, the second aperture being proximate an end of the tapping plate and corresponding with the retaining member and being in communication with the third aperture;

d) an adjusting member within the third aperture;

e) a fastener, the retaining member of the bracket engaging the fastener to prevent movement along a longitudinal axis of the fastener, the fastener extending through the second aperture into the third aperture and configured and arranged to mate with the adjusting member; and f) a hinge member operatively connected to the outer surface of the outer panel of the adjustable door with a second fastener, the second fastener extending through the first aperture of the outer panel and into the tapping plate, the fastener allowing movement of the hinge member when the second fastener is loosened and the fastener is rotated relative to the adjusting member, the adjusting member moving along the fastener as the fastener is rotated thereby moving the tapping plate relative to the fastener and the bracket which moves the second fastener and the hinge member relative to the outer panel.

7. The adjustable door of claim 6, further comprising a fourth aperture in the outer panel of the adjustable door allowing access to the fastener and further comprising a plug configured and arranged to cover the fourth aperture thereby preventing access to the fastener.

8. The adjustable door of claim 6, wherein the retaining member is a notch configured and arranged to engage a groove of the fastener.

9. The adjustable door of claim 6, wherein the retaining member is a cavity configured and arranged to engage a head of the fastener.

10. A adjustable door configured and arranged to fit within a door frame of a walk-in environmentally conditioned room, the adjustable door having a first panel and a first cavity, the first panel having an inside surface and a first aperture, comprising:

a) a bracket having a front and sides defining a second cavity, one of the sides including a second aperture;

b) a tapping plate configured and arranged to fit within the second cavity of the bracket and operatively connected to the inside surface within the first cavity of the adjustable door with the bracket, the tapping plate including a third aperture and a fourth aperture, the third aperture and the fourth aperture extending perpendicular to one another, the third aperture being proximate an end of the tapping plate and corresponding with the second aperture and being in communication with the fourth aperture;

c) an adjusting member within the third aperture of the tapping plate; and d) a fastener having a groove, the second aperture of the bracket engaging the groove, the fastener extending through the second aperture and the third aperture into the fourth aperture and configured and arranged to mate with the adjusting member, the adjusting member moving along the fastener as the fastener is rotated thereby moving the tapping plate along the fastener as the fastener is rotated, the tapping plate moving relative to the fastener and the bracket.

11. The adjustable door of claim 10, further comprising a hinge operatively connected to the adjustable door with a second fastener, the second fastener extending through the first aperture into the tapping plate, wherein rotation of the fastener moves the tapping plate and the second fastener relative to the adjustable door thereby fitting the adjustable door within the door frame.

12. The adjustable door of claim 10, further comprising a fifth aperture in the first panel of the adjustable door allowing access to the fastener and further comprising a plug configured and arranged to cover the fifth aperture thereby preventing access to the fastener.

* * * * *